US006039433A

United States Patent [19]

Kobayashi et al.

[11] Patent Number: 6,039,433

[45] **Date of Patent: *Mar. 21, 2000**

[54] INK JET RECORDING APPARATUS AND CONTROL METHOD THEREOF

[75] Inventors: Hideyuki Kobayashi; Mitsuru Kishimoto; Noboru Ooishi; Kiyoshi Ikeda, all of Tokyo, Japan

[73] Assignee: Oki Data Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/917,375

[22] Filed: Aug. 26, 1997

[30] Foreign Application Priority Data

Aug. 28, 1996 [JP] Japan ..... 8-245548

[51] Int. Cl.[7] ..... B41J 2/145; B41J 2/15; B41J 29/38

[52] U.S. Cl. ..... 347/40; 347/14; 347/5

[58] Field of Search ..... 347/43, 40, 15, 347/14, 5

[56] References Cited

U.S. PATENT DOCUMENTS

| | | | |
|---|---|---|---|
| 5,079,571 | 1/1992 | Eriksen | 347/43 |
| 5,220,342 | 6/1993 | Moriyama | 347/15 |
| 5,455,610 | 10/1995 | Harrington | 347/43 |
| 5,512,923 | 4/1996 | Bauman et al. | 347/15 |
| 5,600,353 | 2/1997 | Hichman et al. | 347/43 |
| 5,602,579 | 2/1997 | Ambalavanar et al. | 347/240 |
| 5,777,634 | 7/1998 | Okamura et al. | 347/7 |

FOREIGN PATENT DOCUMENTS

| | | | |
|---|---|---|---|
| 60-199662 | 10/1985 | Japan | 347/43 |

*Primary Examiner*—N. Le
*Assistant Examiner*—Thinh Nguyen
*Attorney, Agent, or Firm*—Rabin & Champagne, P.C.

[57] ABSTRACT

An ink jet recording apparatus includes a printhead that ejects black ink drops and colored ink drops through a plurality of corresponding ink nozzles in accordance with print data. The printhead ejects ink drops when the printhead is moved to scan a recording medium in a forward direction and a reverse direction opposite to the forward direction. The forward and reverse directions are perpendicular to a direction in which the recording medium travels. A print data identifier separates the print data for a line into black print data and color print data. A print data selector supplies one of the black print data and color print data to the printhead when the printhead scans the recording medium in the forward direction, and the other of the black print data and color print data to the printhead when the printhead scans the recording medium in the reverse direction.

19 Claims, 10 Drawing Sheets

INK JET RECORDING APPARATUS AND CONTROL METHOD THEREOF

BACKGROUND OF THE INVENTION

1. Field of the Invention

The present invention relates to an ink jet recording apparatus in which wet ink drops landing on closely located dot positions are prevented from bleeding to mix together, and a method of controlling the operation of an ink Jet recording apparatus.

2. Description of Related Art

A conventional ink jet recording apparatus for color printing has a printhead mounted on a carriage and the printhead is equipped with a plurality of ink nozzles through which ink drops of various colors are ejected. Each of the ink nozzles ejects ink drops of a corresponding color in accordance with print data which is received from a host apparatus such as a personal computer. Ink involved in this type of recording apparatus includes black ink, yellow ink, magenta ink, and cyan ink.

Ink drops of black and other colors are ejected in random order, so that black ink drops and adjacent ink drops of other colors may land on the print medium at almost the same time. The ink drops of different colors are still wet and may bleed after landing at predetermined positions, reaching adjacent drops. This results in poor print quality.

Some of apparatuses of this type employ a bi-direction printing method where when the carriage is moved to reciprocally scan the recording medium such as recording paper, printing operation is performed not only when the carriage moves in the forward direction but also when the carriage moves in the reverse direction. Therefore, the printhead may stop at different positions and run at different speeds, causing ink drops to land on positions slightly deviated from where they are aimed to land. Thus, the bi-direction printing method presents more chances of unwanted mixing of black ink and other colored ink, which is detrimental to high quality color printing.

SUMMARY OF THE INVENTION

An object of the invention is to provide an ink jet recording apparatus where wet black ink drops landing on dot positions are prevented from bleeding to mix with other colored ink drops landing on dot positions close to those of black ink drops.

Another object of the invention is to provide an ink jet recording apparatus where the same tints of hues are maintained between lines throughout the printed pages.

Still another object of the invention is to provide a method of controlling the operation of such an ink jet recording apparatus in which wet black ink drops landing on dot positions are prevented from bleeding to mix with other colored ink drops landing on dot positions close to black ink drops.

Yet another object of the invention is to provide a method of controlling the operation of such an ink jet recording apparatus where the same tints of hues are maintained between lines throughout the printed pages.

An ink jet recording apparatus includes a printhead which ejects black ink drops and colored ink drops through a plurality of corresponding ink nozzles. The ink drops are ejected in accordance with print data when the printhead is moved to scan a recording medium in a first direction and a second direction opposite to the first direction. The first and second directions are perpendicular to a direction in which the recording medium travels.

A print data identifier separates the print data for a line into black print data and color print data. A print data selector supplies one of the black print data and color print data to the printhead when the printhead scans the recording medium in the first direction, and the other of the black print data and color print data to the printhead when the printhead scans the recording medium in the second direction. The printhead ejects colored ink drops only when the printhead scans the recording medium in the first direction or only when printhead scans the recording medium in the second direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting of the present invention, and wherein.

DETAILED DESCRIPTION OF THE INVENTION

Preferred embodiments of the invention will be described in detail with reference to the accompanying drawings.

First Embodiment

Figure 1:
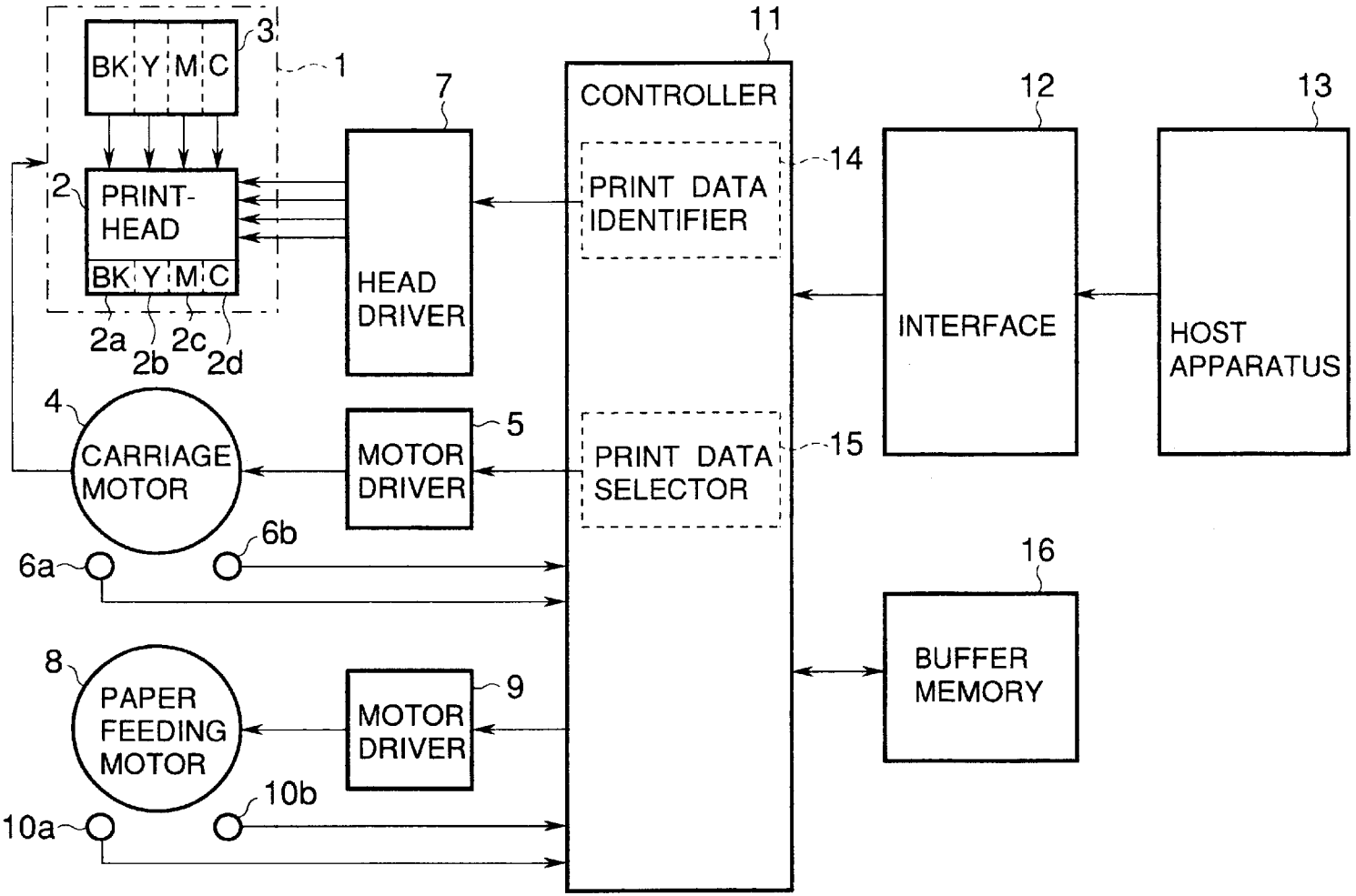
FIG. 1 is a block diagram showing a construction of an ink jet recording apparatus of the invention.

FIG. 1 is a block diagram of an ink jet recording apparatus of the invention. Referring to FIG. 1, a carriage 1 carries a printhead 2 and ink tanks 3 thereon. The printhead 2 includes a plurality of ink nozzles 2*a*, 2*b*, 2*c*, and 2*d* which eject black ink, yellow ink, magenta ink, and cyan ink, respectively. The ink tanks 3 hold ink of the respective colors and supply the ink to the corresponding ink nozzles.

The carriage 1 is driven by a drive mechanism to reciprocally move in a main scanning direction so that the printhead 2 reciprocally scans the recording paper 17 (FIG. 5) ejecting ink drops. The main scanning direction is perpendicular to a sub scanning direction in which the recording paper travels as the printhead 2 scans the recording paper 17 from line to line. The drive mechanism includes a carriage motor 4 controlled by a motor driver 5 to rotate in the forward and reverse directions. A position detector 6*a* is disposed at a home position where the carriage 1 starts to scan the recording paper forwardly (forward direction) in the main scanning direction, and a position detector 6*b* is disposed at a halt position where the carriage 1 is halted before it starts to scan the recording paper reversely (reverse direction) in the main scanning direction.

The printhead 2 is connected to a head driver 7 which decodes ink-nozzle drive signals and drives the printhead 2 in accordance with the decoded ink-nozzle drive signals, so that each of the ink nozzles 2*a*–2*d* ejects ink of a corresponding color.

The recording paper as a recording medium is advanced by a paper feeding motor 8 in the sub scanning direction, i.e., a direction perpendicular to the main scanning direction. The paper feeding motor 8 is driven by a motor driver 9. The presence and location of the recording paper are detected by paper sensors 10*a* and 10*b*.

A controller 11 is connected to the motor drivers 5 and 9, head driver 7, position detectors 6*a* and 6*b*, and paper sensors 10*a* and 10*b*. The controller 11 includes an arithmetic operation circuit including a microprocessor, program memory, and other circuits, and controls the various sections of the recording apparatus.

The controller 11 is connected to a host apparatus 13 via an interface 12. The host apparatus 13 is for example, a personal computer or the like which sends print data to the controller 11.

The controller 11 incorporates a print data identifier 14 and a print data selector 15. The print data identifier 14 checks the print data or nozzle drive signal contained in the print data supplied from the host apparatus 13, thereby determining whether the print data is for black ink, yellow ink, magenta ink, or cyan ink. When the print data identifier 14 has identified print data for one line or a predetermined number of lines to be printed, the controller 11 stores two items of data into a buffer memory 16, the black print data being stored into one predetermined area of the address region and color print data into the other area.

When the carriage 1 is scanning the recording paper in the forward direction, the print data selector 15 receives the black print data from the buffer memory 16 and sends the received black print data to the head driver 7. When the carriage 1 is scanning the recording paper in the reverse direction, the print data selector 15 receives the color print data from the buffer memory 16 and sends the received color print data to the head driver 7.

Figure 2:
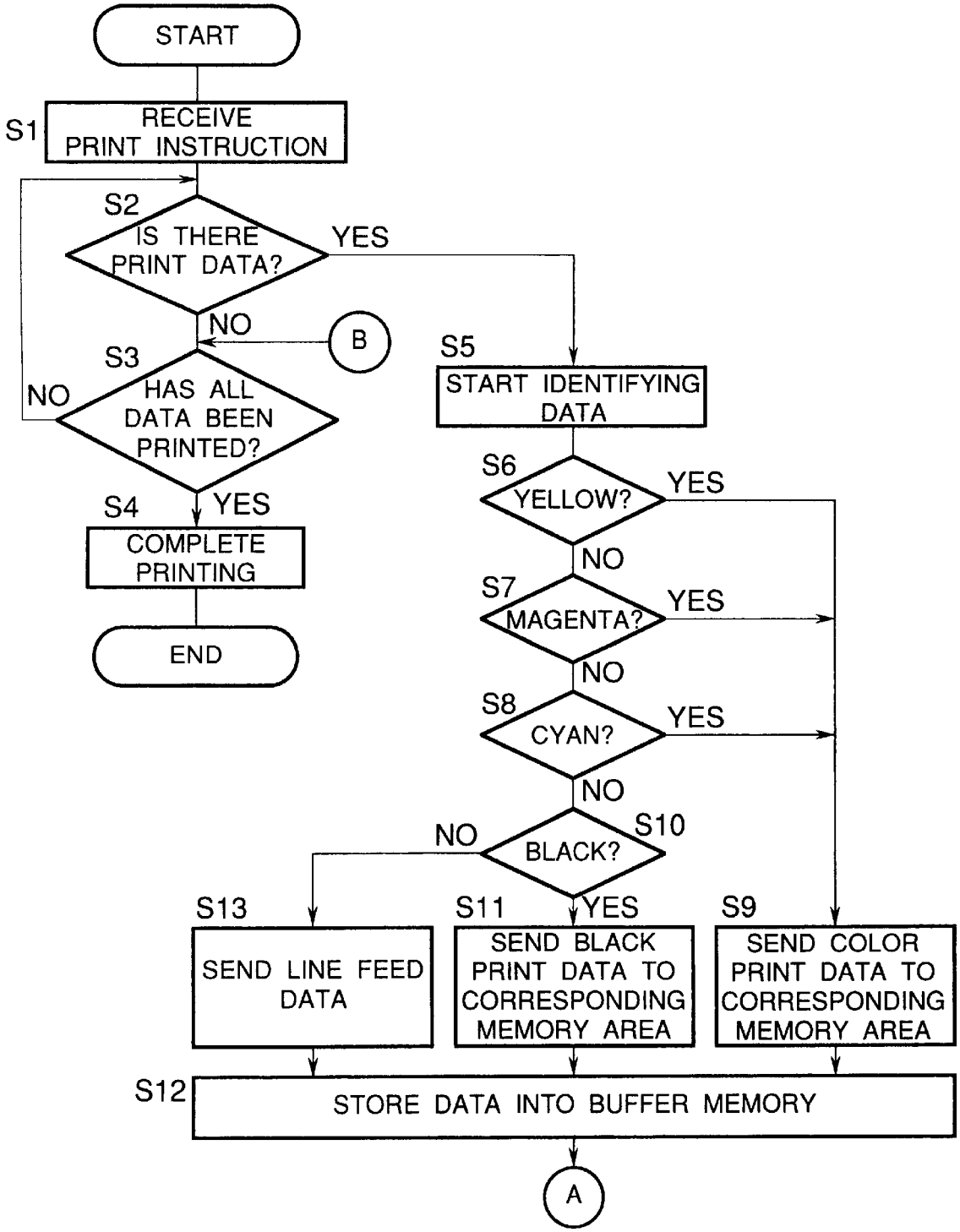
FIGS. 2, 3, and 4 are flowcharts illustrating the operation of an ink jet recording apparatus of a first embodiment.

The operation of an ink jet recording apparatus of the aforementioned construction and a method of controlling the apparatus will be described with reference to flowcharts shown in FIGS. 2, 3 and 4. Referring to FIG. 2, upon receiving a print instruction from the host apparatus 13 at step S1, the controller 11 checks the buffer memory 16 at step S2 to determine whether there is print data in the buffer memory 16. If there is no print data in the buffer memory 16, the controller waits for print data.

If there is print data in the buffer memory 16, the print data identifier 14 checks the print data at steps S5–S8 to determine whether the color print data is for yellow ink, magenta ink, or cyan ink. If the print data indicates any one of these colors, the controller 11 sends at step S9 the color print data into a corresponding color print data area in the buffer memory 16 so as to store the color print data therein at step S12.

If the print data identifier 14 identifies at step S10 that the print data is for black ink, the controller 11 sends at step S11 the print data into a corresponding black print data area in the buffer memory 16 so as to store the data therein at step S12. The print data identifier 14 performs the above-mentioned color-identifying operation for one or several lines and the buffer memory 16 stores the identified color print data in different locations thereof according to color.

At step S13, if the print data is determined to be line-feeding data, the controller 11 stores the line-feeding data into a corresponding area in the buffer memory 16, so that the motor driver 9 drives the paper feeding motor 8 to feed the recording paper one line ahead in the sub scanning direction.

Figure 3:
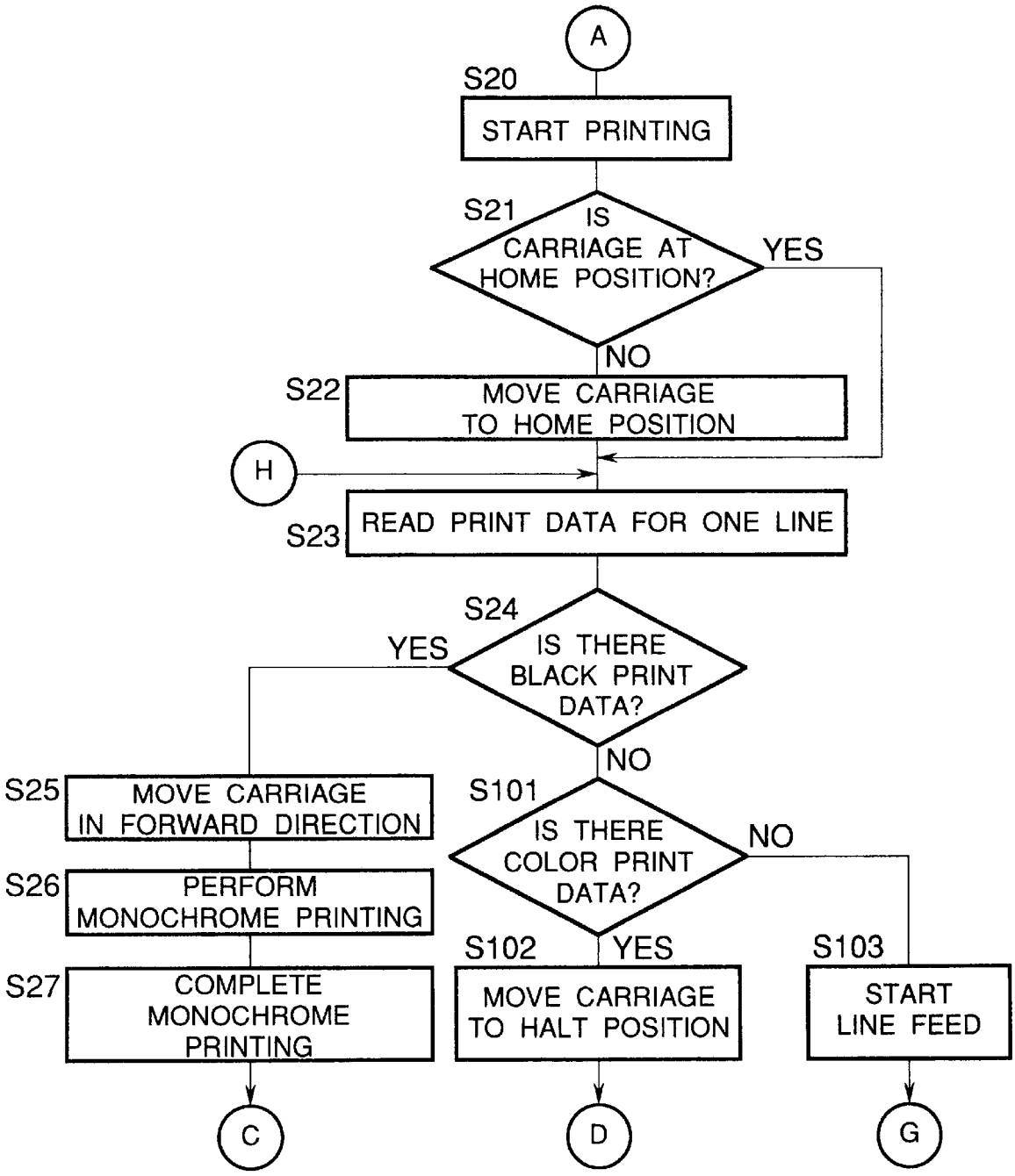
Figure 4:
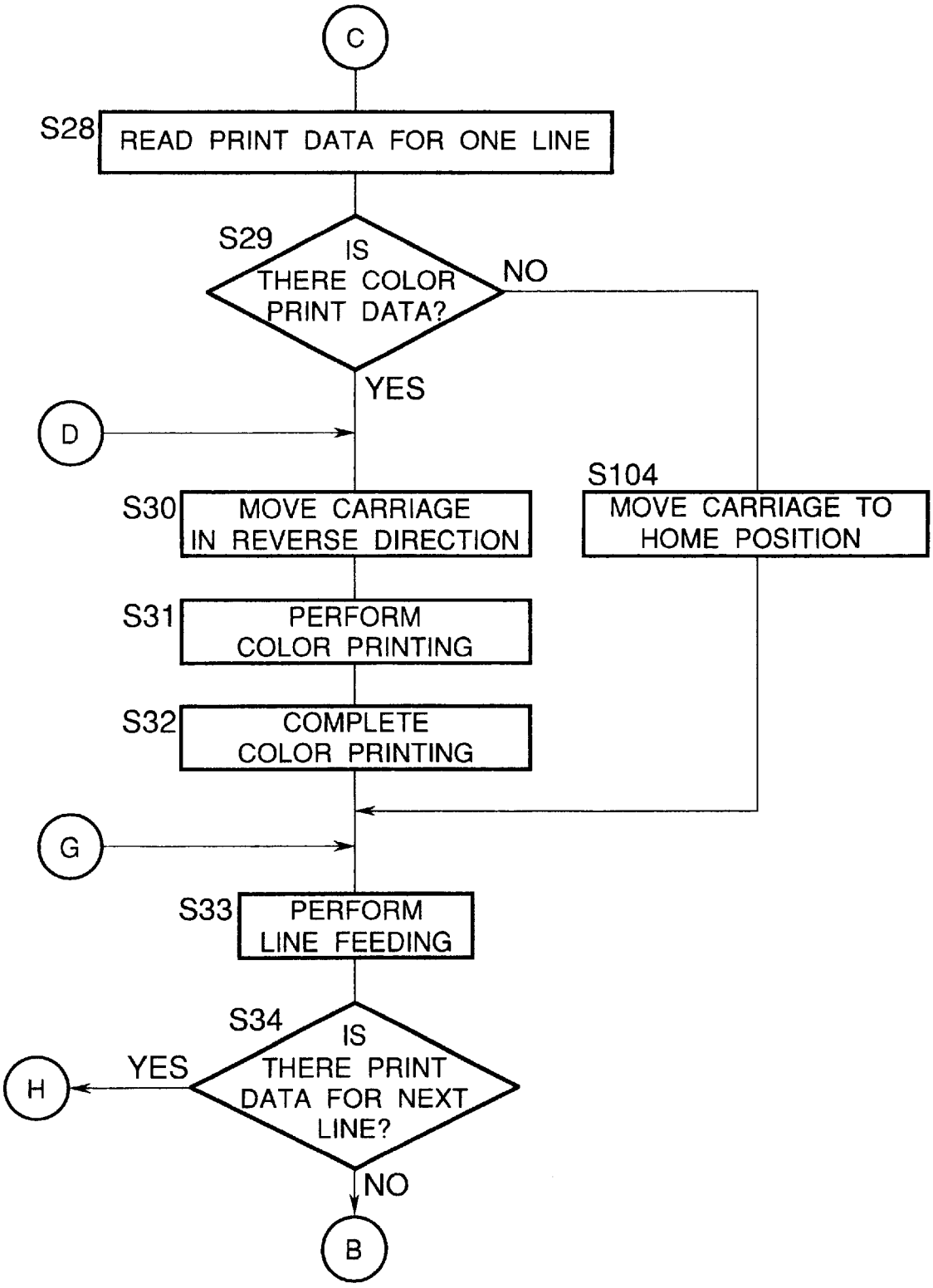

As shown in FIG. 3, the controller 11 starts printing at step S20. At step S21, the controller 11 checks a detection signal received from the position detector 6*a* to determine whether the carriage 1 has been positioned at its predetermined home position. If the carriage 1 has not been positioned at the home position, then the controller 11 causes the motor driver 5 to drive the carriage motor 4, thereby moving the carriage 1 to the home position (step S22).

Then, the print data selector 15 reads print data for one line to be printed from the buffer memory 16 (steps S23). A check is made to determine whether the print data contains black print data (step S24). If the print data contains black print data, then the controller 11 supplies the black print data to the head driver 7. The head driver 7 sends drive signals to the printhead 2 so that the ink nozzle 2*a* corresponding to black ink is driven in accordance with the drive signals.

At step S25, the controller 11 causes the motor driver 5 to drive the carriage motor 4 so that the carriage 1 scans the recording paper in the forward direction.

Thus, the ink nozzle 2*a* ejects black ink drops to the recording paper, performing a monochrome printing for one line in the forward direction (step S26). When the carriage 1 arrives at the halt position after having completed the monochrome printing in the forward direction (step S27), the position detector 6*b* generates a detection signal. In response to the detection signal, the controller 11 causes the motor drive 5 to stop the carriage 1.

Then, at step S28, the print data selector 15 reads from the buffer memory 16 print data for the same line that contained the aforementioned black print data, and checks the print data to determine whether the print data contains color print data (step S29). If the print data contains color print data, then the print data selector 15 sends the color print data to the head driver 7. The head driver 7 sends drive signals to the printhead 2, so that each of the ink nozzles 2*b*–2*d* ejects a corresponding colored ink drop.

The controller 11 controls the motor driver 5 so that the carriage motor 4 rotates in the reverse direction, the carriage 1 scanning the recording paper from the halt position toward the home position (step S30).

The ink nozzles 2*b*, 2*c*, and 2*d* eject yellow ink, magenta ink, and cyan ink, respectively, to the recording paper in accordance with the color print data as the carriage 1 moves toward the home position, thereby performing a color printing for one line in the reverse direction (step S31).

When the carriage 1 has returned to the home position after the color printing (step S32), the position detector 6*a* generates a detection signal to the controller 11. In response to the detection signal, the controller 11 controls the motor driver 5 so that the carriage 1 stops scanning in the reverse direction.

Subsequently, the controller 11 causes the motor driver 9 to drive the paper-feeding motor 8 at step S33 so that the recording paper is caused to travel one line ahead, while also determining at step S34 whether the buffer memory 16 holds print data for the next one line.

If the buffer memory 16 holds print data for the next one line, the program returns to step S23 shown in FIG. 3 and the controller 11 repeats the aforementioned steps. If the buffer memory 16 does not hold print data for the next one line, the program returns to step S3 shown in FIG. 2 where a check is made to determine whether the printing operation has completed.

As mentioned above, only black ink drops are ejected when the carriage 1 scans the recording paper in the forward direction and colored ink drops are ejected when the carriage 1 scans in the reverse direction. The black ink drops on the recording paper will have dried up by the time that the ejection of the colored ink drops begins, preventing black ink drops from bleeding to mix with other color ink drops subsequently landing on the recording paper. This operation allows high quality color printing to be performed while still maintaining the same printing speed.

The aforementioned operation of the recording apparatus has been described with respect to a case where print data for one line contains black print data and color print data.

If the print data does not contain black print data, then, a check is made at step S101 to determine whether the print data contains color print data. If the answer is YES at step S101, then the controller 11 causes the motor driver 5 to drive the carriage motor 4 so that the carriage 1 moves in the forward direction without ejecting ink drops and stops at the halt position (step S102). Thereafter, the program proceeds to step S30 shown in FIG. 4 so that the carriage 1 starts to scan the recording paper in the reverse direction for color printing operation (step S31).

If the answer is NO at step S101, then the print data is identified to be line-feeding data and the program proceeds to step S103 where line feeding is started. In other words, the recording paper is advanced one line ahead. After completion of color printing at step S32, the controller 11 performs line feeding at step S33 so that the recording paper is advanced one line ahead.

If the answer is NO at step S29, it is implied that the print data read from the buffer memory 16 contains only black print data. Thus, at step S104, the controller 11 causes the motor driver 5 to drive the carriage motor 4, so that the carriage 1 returns to the home position.

Figure 5:
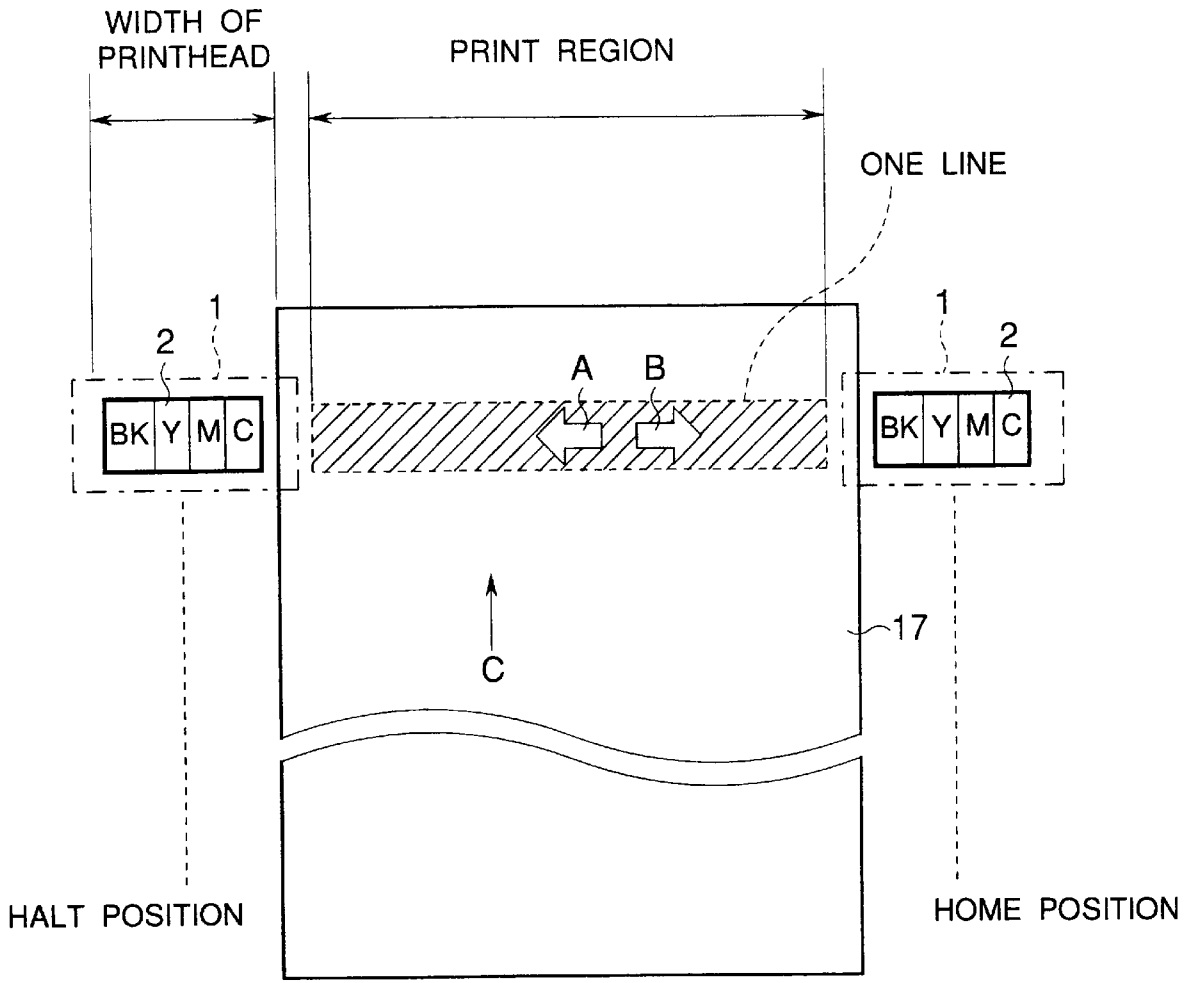
FIG. 5 illustrates the positional relation between the carriage and the recording paper.

FIG. 5 illustrates the positional relation between the carriage 1 and the recording paper 17. Referring to FIG. 5, the carriage 1 on which the printhead 2 is mounted is at its home position outside of an area occupied by the recording paper 17.

The printhead 2 is first driven in accordance with the black print data when the carriage 1 is being moved to scan the recording paper in the forward direction as shown by arrow A. The carriage 1 must be moved in the forward direction to the halt position beyond the print region of the recording paper 17, so that the carriage 1 can be sufficiently accelerated to a constant speed before the ink nozzle 2*d* (indicated at C) for cyan ink reaches the left edge of the recording paper 17 when printing operation is performed in the reverse direction shown by arrow B. Therefore, the printhead 2 is moved from the home position to the halt position across a distance of about the print region of the recording paper 17 plus the width of the printhead 2.

After the carriage 1 has moved beyond the print region of the recording paper, the carriage 1 is decelerated until it comes to a stop. Then, the direction of movement of the carriage 1 is switched from the forward direction to the reverse direction. Then, the carriage 1 is accelerated in the reverse direction for color printing so that it reaches a predetermined constant speed before it again enters the print region of the recording paper. Thus, it takes some time for the carriage 1 to be decelerated, switched from the forward movement to the reverse movement, and accelerated, so that the black ink drops most recently landed on the recording paper 17 will have dried up before colored ink drops are ejected for color printing. Therefore, the operation of the present invention prevents wet black ink drops from mixing with the other colored ink drops.

The operation of the ink jet recording apparatus may be modified so that colored ink drops are ejected when the carriage 1 moves in the forward direction and black ink drops are ejected when the carriage 1 moves in the reverse direction.

Second Embodiment

Figure 6:
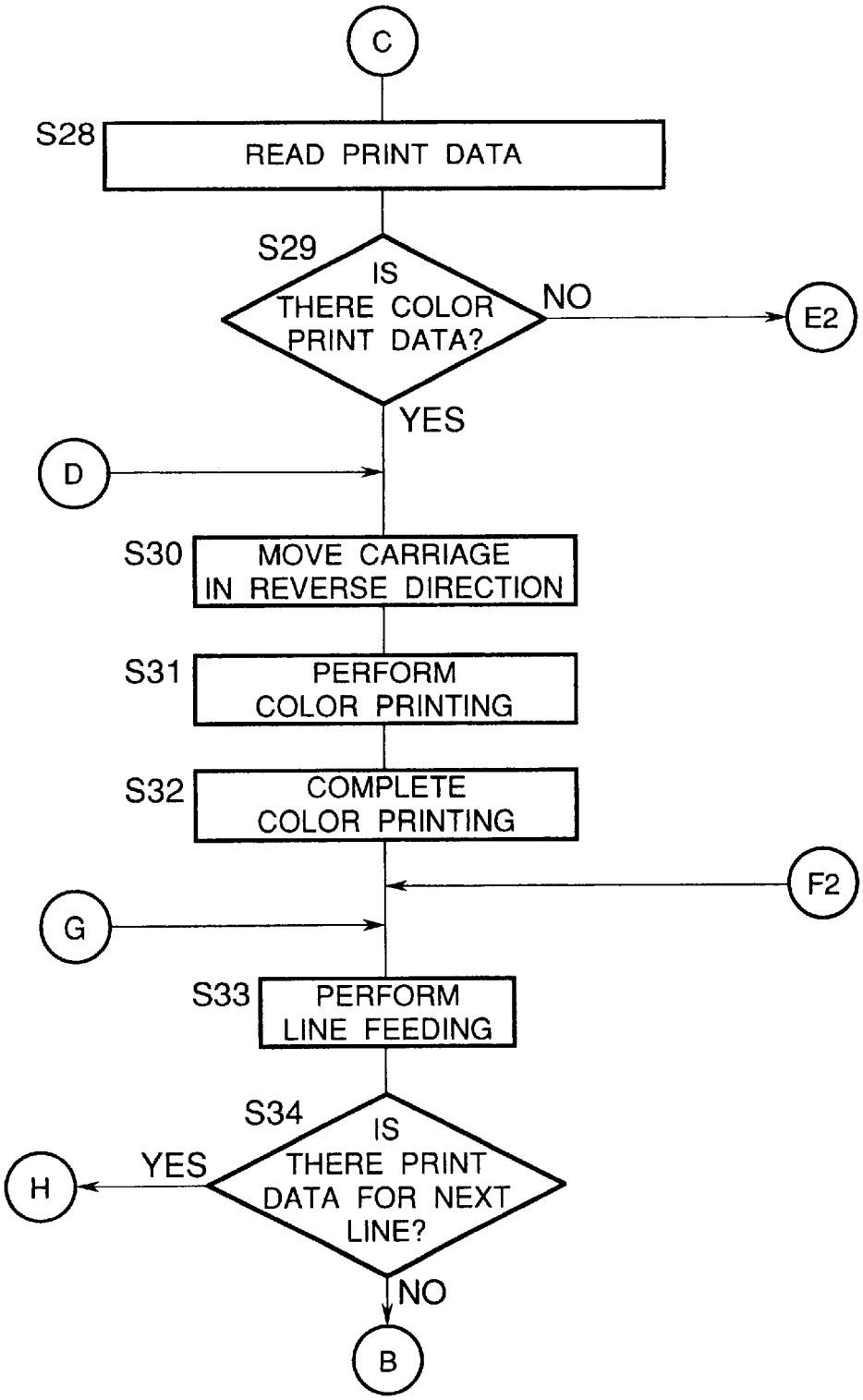
FIGS. 6 and 7 are flowcharts illustrating the operation and control method of an ink jet recording apparatus according to a second embodiment.
Figure 7:
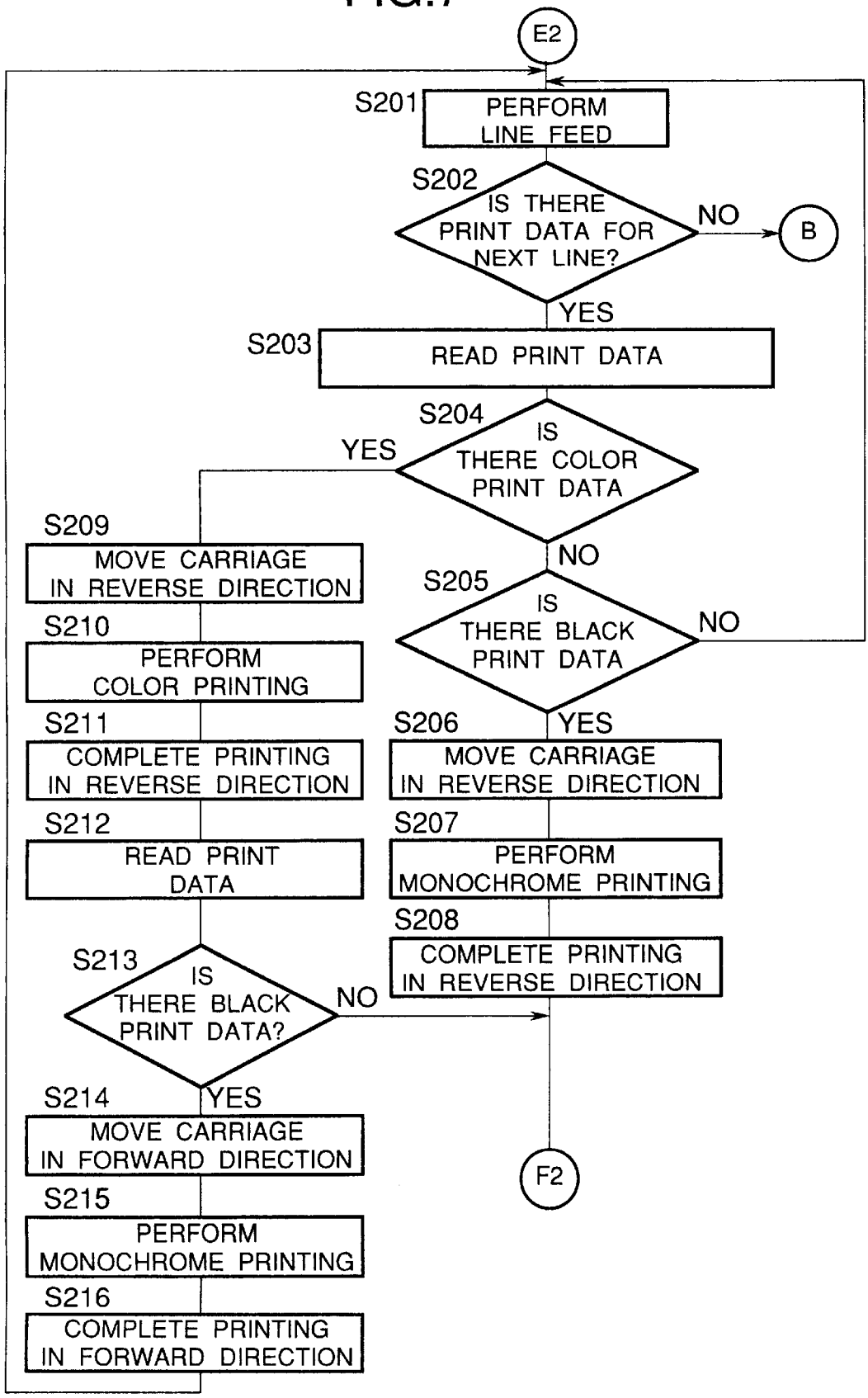

The configuration of the ink jet recording apparatus of a second embodiment is the same as that shown in FIG. 1. The operation of the print data identifier 14 is exactly the same as that shown by the flowchart in FIG. 2. The operation from steps S29–S34 in FIGS. 2–4 and S101–103 in FIG. 3 also applicable to the second embodiment, and description thereof is omitted. FIGS. 6 and 7 are flowcharts showing the operation and control method of an ink jet recording apparatus according to the second embodiment.

Thus, only the operation different from the first embodiment will be described with reference to FIGS. 6 and 7.

If the answer is NO at step S29 in FIG. 6, it is implied that all the print data is for black ink only, and the program proceeds to step S201 shown in FIG. 7.

The controller 11 completes printing operation for the line and the carriage 1 remains halted at the halt position. Then, the controller 11 causes the motor driver 9 to drive the paper-feeding motor 8, thereby advancing the recording paper one line ahead (step S201).

If the controller 11 determines at step S202 that there is print data for the next line, then the print data selector 15 reads print data for the next line from the buffer memory 16 (step S203).

If it is determined at step S204 that the print data contains color print data, then the program proceeds to step S209. If the answer is NO at step S204, then a check is made at step S205 to determine whether the print data contains black print data.

If the answer is YES at step S205, the controller 11 causes the motor driver 5 to rotate the carriage motor 4 in the reverse direction, thereby moving the carriage 1 to move in the reverse direction (step S206). Then, the print data selector 15 sends the black print data to the head driver 7. The head driver 7 sends drive signals to the printhead 2, the drive signals driving the ink nozzle 2*a*. Black ink drops ejected from the ink nozzle 2*a* land on the recording paper as the carriage moves in the reverse direction (step S207), thereby performing monochrome printing for two consecutive lines in one complete return trip of the carriage 1 and completing at step S208. This implies that the monochrome printing may be performed at high speed if only the monochrome printing is to be performed for consecutive lines.

When the carriage 1 has returned to the home position, the program jumps to step S33 where the recording paper is advanced one line ahead.

If the answer is YES at step S204, the controller 11 causes the carriage 1 to move in the reverse direction at step S209. The print data selector 15 first reads color print data from the buffer memory 16 and sends the color print data to the head driver 7. Then, the head driver 7 provides drive signals to the printhead 2 so that the nozzles 2*b*, 2*c*, and 2*d* eject corresponding colored ink. The color printing completes at step S211.

Subsequently, the print data selector 15 reads print data from the buffer memory 16 at step S212 and checks the print data at step S213 to determine whether the data is black print data. If the answer is YES at step S213, then the print data selector 15 provides the black print data to the head driver 7. The controller 11 causes the carriage 1 to move in the forward direction without performing line feeding (step S214), and then starts monochrome printing at step S215 and completes monochrome printing at step S216.

If the answer is NO at step S205, then the program jumps to step S201.

In the conventional bi-direction printing method, ink drops of respective colors are ejected in the order of yellow, magenta, and cyan when printing in the forward direction, and in the order of cyan, magenta, and yellow when printing in the reverse direction. As a result, the order in which ink drops of respective colors are printed may be opposite depending on lines, resulting in different tints of hues between lines. In order to solve this problem, in the present invention, ink drops of the respective colors are ejected when the printhead scans the recording paper either in the forward direction or in the revere direction. Therefore, colored ink drops are ejected always in the same order so that the same tints of hues are maintained throughout the printed page.

Third Embodiment

The configuration of the ink jet recording apparatus of the third embodiment is the same as that shown in FIG. 1. The operation of the print data identifier 14 is exactly the same as that shown in FIG. 2 and description thereof is omitted. In other words, the print data is grouped into black print data and color print data which is stored into separate memory areas in the buffer memory 16. The operation from steps S29–S34 in FIGS. 2–4 and S101–103 in FIG. 3 also applicable to the third embodiment, and description thereof is omitted.

The operation of an ink jet recording apparatus and a method of controlling the apparatus according to a third embodiment will be now described with reference to flowcharts shown in FIGS. 2, 8, 9, and 10. In the third embodiment, colored ink drops are ejected when the carriage 1 moves in the forward direction and black ink drops are ejected when the carriage 1 moves in the reverse direction.

Figure 8:
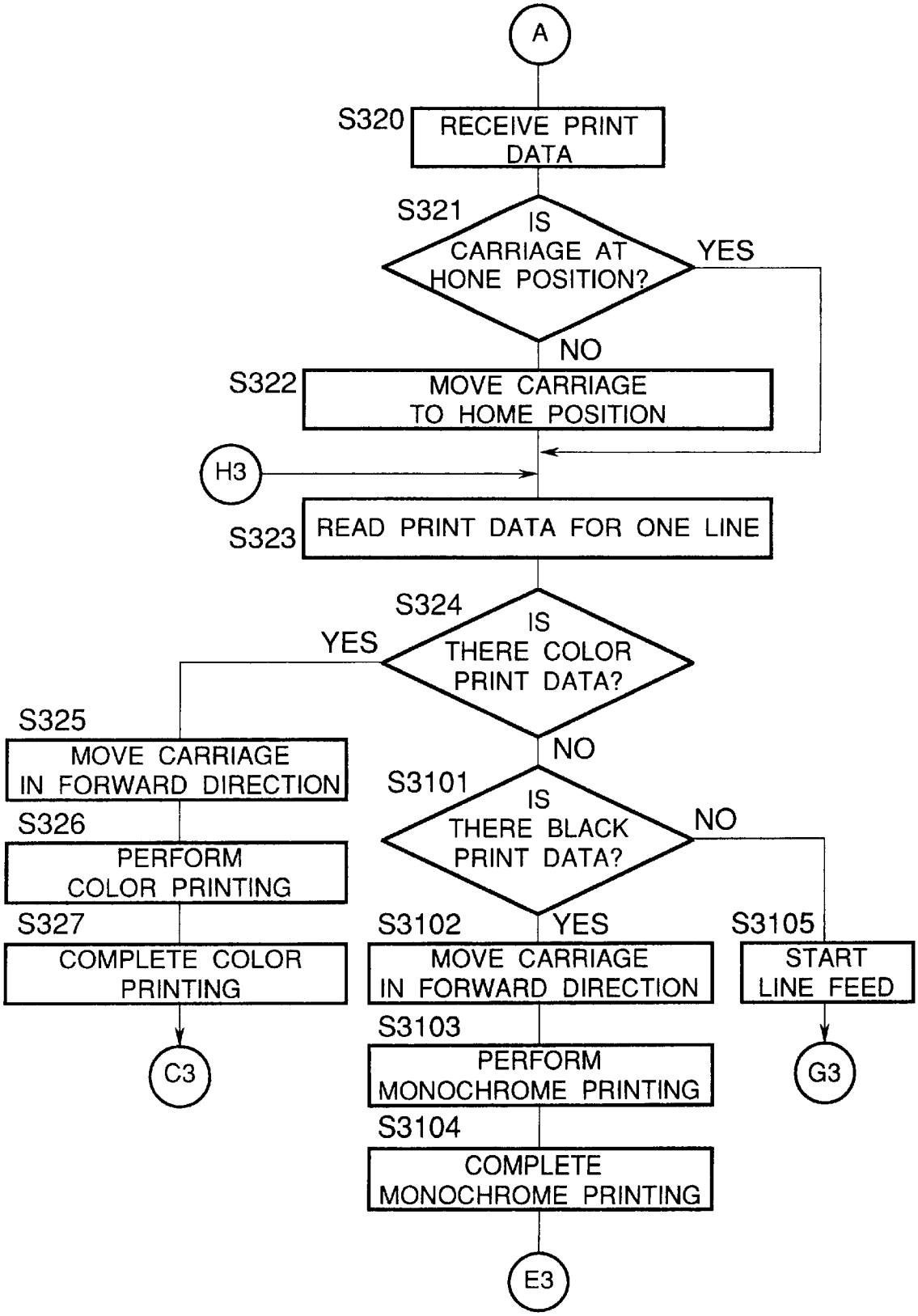
FIGS. 8, 9, and 10 are flowcharts illustrating the operation and control method of an ink jet recording apparatus according to a third embodiment.

As shown in FIG. 8, the controller 11 starts printing at step S320. At step S321, the controller 11 checks a detection signal received from the position detector 6*a* to determine whether the carriage 1 has been positioned at its predetermined home position. If the carriage 1 has not been positioned at the home position, then the controller 11 causes the motor driver 5 to drive the carriage motor 4, thereby moving the carriage 1 to the home position (step S322).

Then, the print data selector 15 reads print data for one line to be printed from the buffer memory 16 (step S323). A check is made to determine whether the print data contains color print data (step S324). If the answer is YES at step S324, then, at step S325 the controller 11 causes the motor driver 5 to drive the carriage motor 4 so that the carriage 1 scans the recording paper in the forward direction.

The controller 11 supplies the color print data to the head driver 7. The head driver 7 sends drive signals to the printhead 2 so that the ink nozzles 2*b*–2*d* are driven in accordance with the drive signals.

Thus, each of the ink nozzles 2*b*–2*d* ejects ink drops of a corresponding color to the recording paper, performing color printing for one line in the forward direction (step S326). When the carriage 1 arrives at the halt position after having completed the color printing in the forward direction (step S327), the position detector 6*b* generates a detection signal. In response to the detection signal, the controller 11 causes the motor drive 5 to stop the carriage 1.

Then, at step S328, the print data selector 15 reads from the buffer memory 16 print data for the same line that contained the aforementioned color print data, and checks the print data to determine whether the print data contains black print data (step S329). If the print data contains black print data, then the print data selector 15 sends the black print data to the head driver 7. The head driver 7 sends drive signals to the printhead 2, so that the ink nozzle 2*a* ejects black ink drops.

The controller 11 controls the motor driver 5 so that the carriage motor 4 rotates in the reverse direction, the carriage 1 scanning the recording paper from the halt position toward the home position (step S330).

The ink nozzle 2*a* ejects black ink drops to the recording paper in accordance with the black print data as the carriage 1 moves toward the home position, thereby performing monochrome printing for one line in the reverse direction (step S331).

When the carriage 1 has returned to the home position after the monochrome printing (step S332), the position detector 6*a* provides a detection signal to the controller 11. In response to the detection signal, the controller 11 controls the motor driver 5 so that the carriage 1 stops scanning in the reverse direction.

Subsequently, the controller 11 causes the motor driver 9 to drive the paper-feeding motor 8 at step S333 so that the recording paper is caused to travel one line ahead, while also determining at step S334 whether the buffer memory 16 holds print data for the next one line.

If the buffer memory 16 holds print data for the next one line, the program returns to step S323 shown in FIG. 8 and the controller 11 repeats the aforementioned steps. If the buffer memory 16 does not hold print data for the next one line, the program returns to step S3 shown in FIG. 2 where a check is made to determine whether the printing operation has been completed.

As mentioned above, only colored ink drops are ejected when the carriage 1 scans the recording paper in the forward direction and black ink drops are ejected when the carriage 1 scans in the reverse direction. The black ink drops on the recording paper will have dried up by the time when the ejection of the colored ink drops begins, preventing black ink drops from bleeding to mix with other color ink drops subsequently landing on the recording paper. This operation allows high quality color printing to be performed while still maintaining the same printing speed.

The aforementioned operation of the recording apparatus has been described with respect to a case where print data for one line contains black print data and color print data.

If the print data does not contain color print data at step S324, then, a check is made at step S3101 to determine whether the print data contains black print data. If the answer is YES at step S3101, then the controller 11 causes the motor driver 5 to drive the carriage motor 4 at step S3102 so that the carriage 1 moves in the forward direction, performing monochrome printing in the forward direction (S3103). After completion of monochrome printing at step S3104, the program proceeds to step S301 shown in FIG. 10 where the recording paper is caused to travel one line ahead.

If the answer is NO at step S3101, it is implied that the print data is line-feeding data and the program proceeds to step S3105 where line feeding is started. In other words, the recording paper is advanced one line ahead at step S333.

Figure 9:
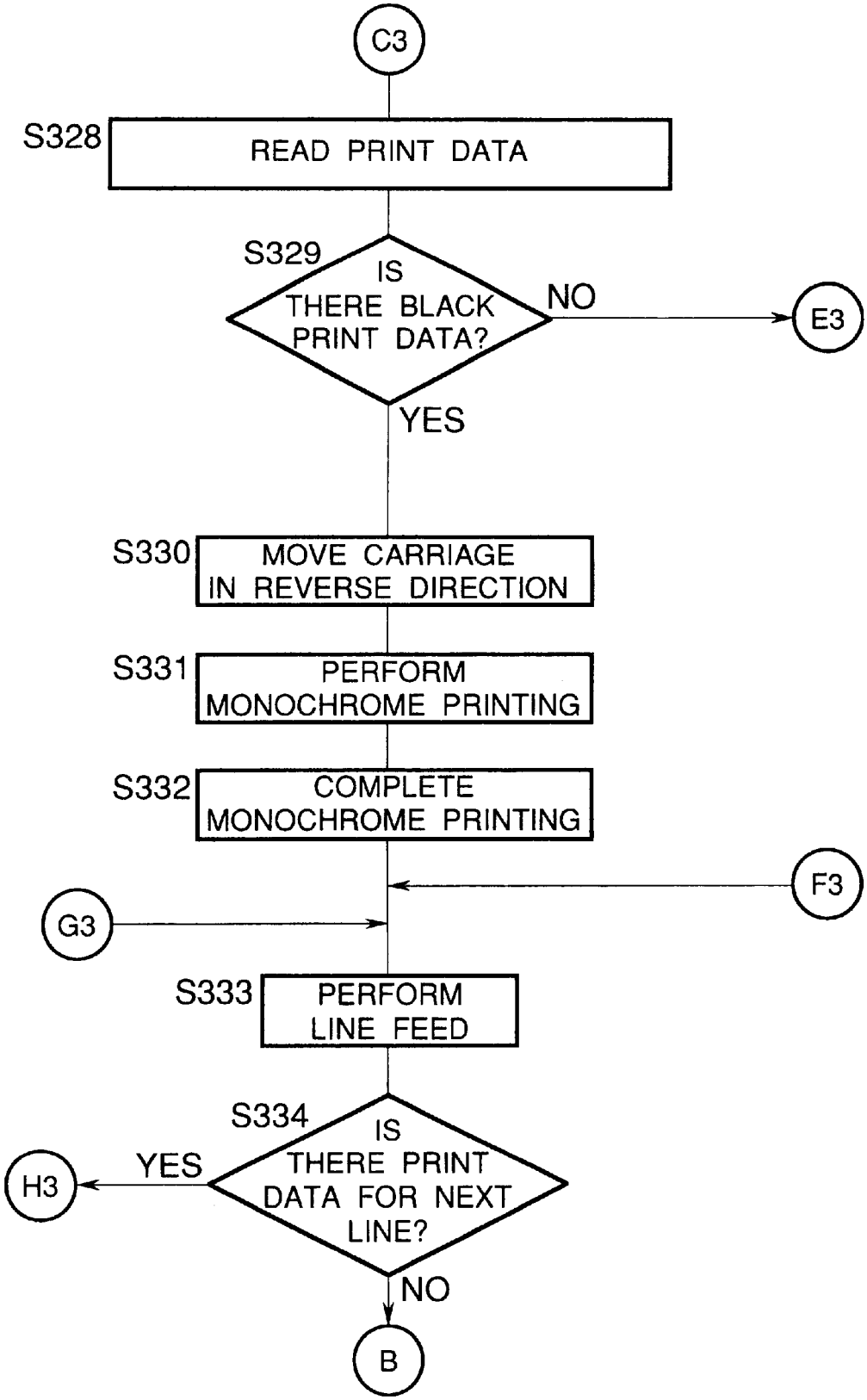
Figure 10:
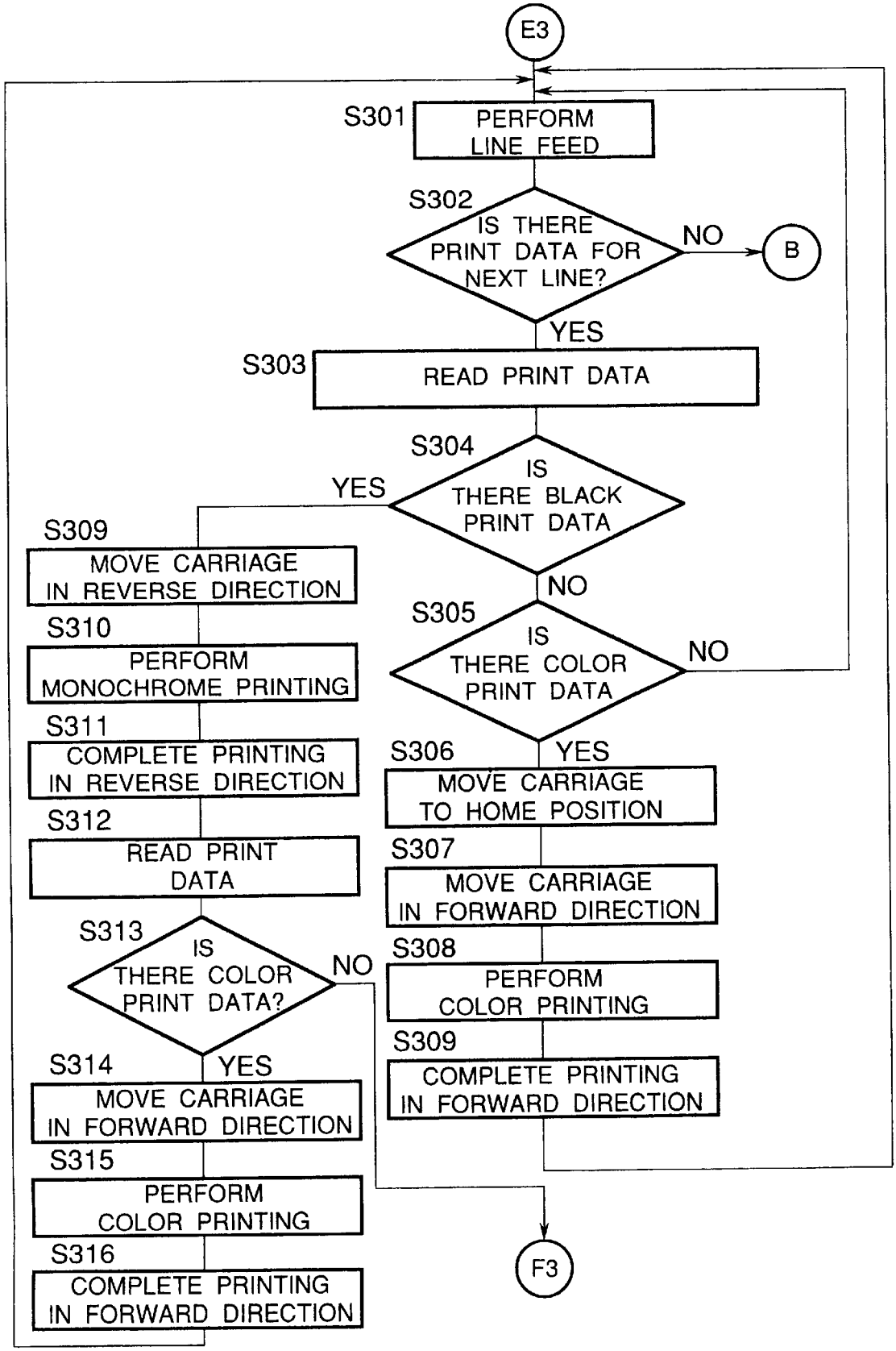

If the answer is NO at step S329 in FIG. 9, it is implied that the print data contains color print data only. The controller 11 completes printing operation for the line and the carriage 1 remains halted at the halt position. Then, the controller 11 causes the motor driver 9 to drive the paper-feeding motor 8, thereby advancing the recording paper one line ahead (step S301).

If the controller 11 determines at step S302 that there is print data for the next line, then the print data selector 15 reads print data for the next line from the buffer memory 16 (step S303).

If it is determined at step S304 that the print data contains black print data, then the program proceeds to step S309. If the answer is NO at step S304, then a check is made at step S305 to determine whether the print data contains color print data.

If the answer is YES at step S305, the controller 11 causes the motor driver 5 to rotate the carriage motor 4 in the reverse direction, thereby moving the carriage 1 to the home position (step S306). Then, the print data selector 15 sends the color print data to the head driver 7. The head driver 7 sends drive signals to the printhead 2, the drive signals driving the ink nozzles 2*b*–2*d*. Colored ink drops ejected from the ink nozzles 2*b*–2*d* land on the recording paper as the carriage moves in the forward direction (step S307), thereby performing color printing (step S308).

After completion of color printing at step S309, the program jumps to step S301 where the recording paper is advanced one line ahead.

If the answer is YES at step S304, the controller 11 causes the carriage 1 to move in the reverse direction at step S309. The print data selector 15 first reads black print data from the buffer memory 16 and sends the black print data to the head driver 7. Then, the head driver 7 outputs drive signals to the printhead 2 so that the nozzle 2*a* ejects black ink drops. This monochrome printing completes at step S311.

Subsequently, the print data selector 15 reads print data from the buffer memory 16 at step S312 and checks the print data at step S313 to determine whether the data is color print data. If the answer is YES at step S313, then the print data selector 15 outputs the color print data to the head driver 7. The controller 11 causes the carriage 1 to move in the forward direction without performing line feeding (step S314), and then starts color printing at step S315 and completes color printing at step S316.

If the answer is NO at step S305, then the program jumps to step S301 17 where the recording paper 17 is caused to travel one line ahead.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet recording apparatus wherein a printhead includes a plurality of ink-ejecting elements by which black ink drops and ink drops of different colors are ejected to a recording medium in accordance with print data when the printhead is moved relative to a recording medium in first and second directions perpendicular to a direction in which the recording medium feeds, the first and second directions being opposite to each other, the plurality of ink-ejecting elements being aligned in a predetermined order in the first direction, wherein each of the plurality of ink-ejecting elements ejects ink drops of a corresponding one of black ink and colored inks, the colored inks including inks of at least three different colors, the ink jet recording apparatus comprising:

a print data identifier, separating the print data for a line into black print data indicative of printing black dots by ejecting black ink on the recording medium and color print data indicative of printing colored dots by ejecting colored inks on the recording medium; and a print data selector, providing only the black print data to the printhead to cause the printhead to eject black ink drops when the printhead is moved relative to the recording medium in the first direction, and providing either only the color print data to the printhead to cause the printhead to eject colored ink drops or only the black print data to the printhead to cause the printhead to eject black ink drops, when the printhead is moved relative to the recording medium in the second direction.

2. The ink jet recording apparatus according to claim 1, wherein the print data selector provides no print data to the printhead when the printhead is moved relative to the recording medium in the second direction, if the print data does not include color print data.

3. The ink jet recording apparatus according to claim 1, wherein the print data selector provides no print data to the printhead when the printhead is moved relative to the recording medium in the first direction, if the print data does not include black print data.

4. The ink jet recording apparatus according to claim 1, further including a recording medium feeding mechanism, which causes the recording medium to feed one line at a time, wherein the print data identifier separates print data for each of a plurality of lines into black print data and color print data.

5. The ink jet recording apparatus according to claim 4, wherein the print data selector provides color print data for one line to the printhead when the printhead is moved relative to the recording medium in the second direction;

wherein if the print data for said one line does not include black print data, the recording medium feeding mechanism causes the recording medium to feed one line ahead after completion of printing of said one line in the second direction; and wherein if the print data for a following line includes black print data, the print data selector provides the black print data of said following line to the printhead when the printhead is moved relative to the recording medium in the first direction.

6. The ink jet recording apparatus according to claim 4, wherein the print data selector provides color print data for one line to the printhead when the printhead is moved relative to the recording medium in the second direction;

wherein if the print data of said one line does not include black print data, the recording medium feeding mechanism causes the recording medium to feed one line ahead after completion of printing of said one line in the second direction;

wherein if print data for a following line does not include black print data, the printhead is moved relative to the recording medium in the first direction without ejecting ink drops; and wherein if the print data for the following line includes color print data, the print data selector provides color print data of said following line to the printhead when the printhead is moved relative to the recording medium in the second direction.

7. The ink jet recording apparatus according to claim 4, wherein the print data selector provides black print data for one line to the printhead when the printhead is moved relative to the recording medium in the first direction;

wherein if the print data for said one line does not include color print data, the recording medium feeding mechanism causes the recording medium to feed one line ahead after completion of printing of said one line in the first direction; and wherein if the print data for a following line includes color print data, the print data selector provides the color print data for the following line to the printhead when the printhead is moved relative to the recording medium in the second direction.

8. The ink jet recording apparatus according to claim 4, wherein the print data selector provides black print data for one line to the printhead when the printhead is moved relative to the recording medium in the first direction;

wherein if the print data for the one line does not include color print data, the recording medium feeding mechanism causes the recording medium to feed one line ahead after completion of printing of said one line in the first direction; and wherein if the print data for a following line includes only black print data, the print data selector provides the black print data for the following line to the printhead when the printhead is moved relative to the recording medium in the second direction.

9. The ink jet recording apparatus according to claim 1, further including a motor driver for moving a carriage on which the printhead is mounted, between a home position and a halt position, when the printhead is moved relative to the recording medium in the first and second directions.

10. The ink jet recording apparatus according to claim 9, wherein the home position and the halt position are located outside of a print region of the recording medium.

11. A method of controlling an ink jet recording apparatus wherein a printhead includes a plurality of ink-ejecting elements by which black ink drops and ink drops of different colors are ejected to a recording medium in accordance with print data when the printhead is moved relative to the recording medium in first and second directions perpendicular to a direction in which the recording medium feeds, the first and second directions being opposite to each other, the plurality of ink-ejecting elements being aligned in a predetermined order in the first direction, wherein each of the plurality of ink-ejecting elements ejects ink drops of a corresponding one of black ink and colored inks, the colored inks including inks of at least different three colors, the method including:

separating the print data for a line into black print data indicative of printing black dots by ejecting black ink on the recording medium and color print data indicative of printing colored dots by ejecting colored inks on the recording medium;

printing by ejecting ink drops in accordance with only the black print data when the printhead is moved relative to the recording medium in the first direction; and printing by ejecting ink drops in accordance with either only the color print data or only the black print data when the printhead is moved relative to the recording medium in the second direction.

12. The method according to claim 11, further including moving a carriage on which the printhead is mounted, between a home position and a halt position, when the printhead is moved relative to the recording medium in the first and second directions.

13. The method according to claim 12, wherein the home position and the halt position are located outside of a print region of the recording medium.

14. The method according to claim 11, further including:

separating the print data for each of a plurality of lines into black print data and color print data; and causing the recording medium to feed one line ahead after completion of printing of each line.

15. The method according to claim 14, further including:

ejecting ink drops in accordance with black print data of one line when the printhead is moved relative to the recording medium in the first direction;

causing the recording medium to feed one line ahead if the print data for said one line includes only black print data;

ejecting ink drops in accordance with color print data of a following line when the printhead is moved relative to the recording medium in the second direction, if print data for a following line includes color print data; and ejecting ink drops in accordance with black print data of said following line when the printhead is moved relative to the recording medium in the first direction, if the print data for said following line includes black print data.

16. The method according to claim 14, further including:

ejecting ink drops in accordance with black print data of one line when the printhead is moved relative to the recording medium in the first direction;

causing the recording medium to feed one line ahead if the print data for said one line does not include color print data;

ejecting ink drops in accordance with black print data of a following line when the printhead is moved relative to the recording medium in the second direction, if the print data for said following line includes only black print data; and ejecting ink drops in accordance with color print data of said following line when the printhead is moved relative to the recording medium in the second direction, if the print data for said following line includes color print data.

17. The method according to claim 14, further including:

ejecting ink drops in accordance with color print data of one line when the printhead is moved relative to the recording medium in the second direction;

causing the recording medium to feed one line ahead if the print data for said one line does not include black print data; and ejecting ink drops in accordance with black print data of a following line when the printhead is moved relative to the recording medium in the first direction, if the print data for said following line includes black print data.

18. The method according to claim 14, further including:

ejecting ink drops in accordance with color print data of one line when the printhead is moved relative to the recording medium in the second direction;

causing the recording medium to feed one line ahead if the print data for said one line does not include black print data;

scanning the recording medium in the first direction without ejecting ink drops if print data for a following line does not include black print data; and ejecting ink drops in accordance with color print data of said following line when the printhead is moved relative to the recording medium in the second direction if the print data for said following line includes color print data.

19. An ink jet recording apparatus wherein a printhead ejects black ink drops and colored ink drops of at least three colors through a plurality of corresponding ink-ejecting elements in accordance with print data when the printhead is moved relative to a recording medium in first and second directions perpendicular to a direction in which the recording medium feeds, the first and second directions being opposite to each other, the ink-ejecting elements being formed in the printhead and aligned in a predetermined order in a direction parallel to the first and second directions, the ink jet recording apparatus comprising:

a print data identifier, separating the print data for a line into black print data and color print data; and a print data selector, causing the printhead to eject colored ink drops in a first order of colors when the printhead is moved relative to the recording medium in the first direction, and causing the printhead to eject colored ink drops in a second direction of colors opposite to the first direction of colors when the printhead is moved relative to the recording medium in the second direction.

* * * * *